US009969468B2

(12) United States Patent
Price, III

(10) Patent No.: US 9,969,468 B2
(45) Date of Patent: May 15, 2018

(54) DEPLOYABLE MARINE SYSTEM

(71) Applicant: AUTO ANCHORING LADDER, LLC, Summerville, SC (US)

(72) Inventor: Frank W. Price, III, Summerville, SC (US)

(73) Assignee: Auto Anchoring Ladder, LLC, Summerville, SC (US)

( * ) Notice: Subject to any disclaimer, the term of this patent is extended or adjusted under 35 U.S.C. 154(b) by 0 days. days.

(21) Appl. No.: 15/443,536

(22) Filed: Feb. 27, 2017

(65) Prior Publication Data

US 2017/0247089 A1 Aug. 31, 2017

Related U.S. Application Data

(60) Provisional application No. 62/299,729, filed on Feb. 25, 2016.

(51) Int. Cl.
*B63B 29/20* (2006.01)
*B63B 21/26* (2006.01)
*B63B 21/30* (2006.01)

(52) U.S. Cl.
CPC ..... *B63B 29/20* (2013.01); *B63B 21/26* (2013.01); *B63B 21/30* (2013.01)

(58) Field of Classification Search
CPC ..... B63B 21/00; B63B 21/22; B63B 21/24; B63B 21/26; B63B 21/28; B63B 21/30; B63B 29/20
USPC ..... 114/294, 295, 362
See application file for complete search history.

(56) References Cited

U.S. PATENT DOCUMENTS 3,571,836 A 3/1971 Dunlap
3,774,720 A 11/1973 Hovey
6,021,733 A 2/2000 Jaramillo, Sr.
6,041,730 A * 3/2000 Oliverio ..... B63B 21/26 114/294
6,789,648 B2 9/2004 Cook
(Continued)

FOREIGN PATENT DOCUMENTS

FR 2235260 1/1975

OTHER PUBLICATIONS

Sea Marine and Auto website, Telescopic Retractable Under Platform Boarding Ladder Stainless Steel 3 Step, http://www.seamarineandauto.com, accessed Oct. 5, 2015.
(Continued)

*Primary Examiner* — Lars A Olson
(74) *Attorney, Agent, or Firm* — Jeffrey T. Stover; Haynsworth Sinkler Boyd, P.A.

(57) ABSTRACT

A deployable marine system for anchoring a vessel in a body of water and to enable a user to ingress into the vessel from the body of water or egress out of the vessel and into the body of water, the deployable marine system includes an anchor-ladder device and a deployment device. The anchor-ladder device includes a first member and one or more steps, the first member including a first end and a second end. The second end is opposite the first end and is associated with an anchoring component that may anchor the vessel. One or more steps may be attached to the first member. The deployment device may be attached to the vessel, connected to the first member in proximity to the first end, and may deploy the anchor-ladder device into, or retract the anchor-ladder device from, the body of water.

21 Claims, 8 Drawing Sheets

(56) References Cited

U.S. PATENT DOCUMENTS

| | | | | |
|---|---|---|---|---|
| 8,381,671 | B2 * | 2/2013 | Bernloehr | B63B 21/30 114/294 |
| 8,579,081 | B2 | 11/2013 | Richey et al. | |
| 8,800,465 | B1 * | 8/2014 | Quail | B63B 21/26 114/294 |
| 8,944,210 | B2 * | 2/2015 | Sedlack, II | B63B 27/146 114/362 |
| 2004/0159279 | A1 * | 8/2004 | Garelick | B63B 27/14 114/362 |
| 2013/0037350 | A1 | 2/2013 | Geiselman, III et al. | |
| 2015/0232157 | A1 | 8/2015 | Fuller, IV et al. | |

OTHER PUBLICATIONS

Sea Marine and Auto website, Hinged Folding Ladder 4 Step Stainless Steel Highly Polished, http://www.seamarineandauto.com, accessed Oct. 5, 2015.

Miller Fall Protection website, PivotLoc Foldable Ladder System, http://www.millerfallprotection.com/fall-protection-products, accessed Oct. 5, 2015.

* cited by examiner (SECTION "A-A")

DEPLOYABLE MARINE SYSTEM

REFERENCE TO RELATED APPLICATION

This application claims priority to U.S. Provisional Patent Application No. 62/299,729, filed Feb. 25, 2016, the entire contents of the provisional application being incorporated herein by reference.

BACKGROUND

Users of marine vessels frequently desire to ingress and egress their vessels in water, such as when visiting a beach, fishing, swimming, etc. Users of marine vessels typically ingress and egress their vessels in water by using a ladder. Ladders on marine vessels tend to be cumbersome, create safety hazards to users, are difficult to deploy and retract, and cane be left down which impedes movement of the small marine vessel. Moreover, users of recreational vessels usually manually anchor the vessel in water prior to egressing the vessel to ensure that the vessel does not float away while the users are away from the vessel. A present need exists for a ladder that can be deployed from a vessel and/or that may anchor the vessel in shallow water.

SUMMARY

According to an implementation described herein, a deployable marine system for anchoring a vessel in a body of water and to enable a user to ingress into the vessel from the body of water or egress out of the vessel and into the body of water may include an anchor-ladder device and a deployment device. The anchor-ladder device may include a first member and one or more steps. The first member may include a first end and a second end opposite the first end, the second end being associated with an anchoring component that is connectable to a bottom of the body of water to anchor the vessel. The one or more steps may be attached to the first member and may be able to support the loads imparted by the user when ingressing into or egressing out of the vessel. The deployment device may be attached to the vessel and may be connected to the first member in proximity to the first end of the first member. The deployment device may be able to deploy the anchor-ladder device into the body of water or to retract the anchor-ladder device from the body of water.

According to another implementation described herein, an anchor-ladder device for anchoring a vessel in a body of water and to enable a user to ingress into the vessel from the body of water or egress out of the vessel and into the body of water, may include a member and one or more steps attached to the member and able to support the loads imparted by the user when ingressing into or egressing out of the vessel. The member may include a first end and a second end opposite the first end. The first end of the member may be connectable to a rod mechanism or a deployment device. The second end of the member may be associated with an anchoring component that is connectable to a bottom of the body of water to anchor the vessel. The member may further include a hollow channel and a rod that extends longitudinally through the hollow channel. The rod may further include a third end that is connectable to a deployment device or a rod mechanism and a fourth end connected to the anchoring component.

According to a further implementation described herein, an anchor-ladder device for anchoring a vessel in a body of water and to enable a user to ingress into the vessel from the body of water or egress out of the vessel and into the body of water, may include a first member having a first end and a second end opposite the first end, the second end being associated with an anchoring component that is connectable to a bottom of the body of water to anchor the vessel, the first end being connectable to a deployment device. The anchor-ladder device may further include a second member generally parallel with the first member. The anchor-ladder device may further include one or more steps pivotally connected to the first member and the second member, the one or more steps being able to support the loads imparted by the user when ingressing into or egressing out of the vessel.

DETAILED DESCRIPTION OF THE DRAWINGS

FIGS. 1A through 7 are attached hereto and fully incorporated herein. The following detailed description refers to the accompanying FIGS. 1A through 7. The same reference numbers in different figures may identify the same or similar elements.

An apparatus, system, method and/or technology, as described herein, may include a deployable marine system that may: (1) anchor a vessel in a body of water; (2) enable users to safely and comfortably ingress and egress the vessel; and (3) anchor the vessel in a body of water and simultaneously enable users to safely and comfortably ingress and egress the vessel. For example, the deployable marine system may include an anchor-ladder device that, when deployed in a manner described herein, anchors a vessel in a body of water. The anchor-ladder device may include one or more steps (described in greater detail below) to enable users to safely and comfortably ingress from the water to the vessel and/or egress from the vessel to the water. The anchor-ladder device may also, or alternatively, include an anchoring component to anchor the vessel to the bottom. The anchor-ladder device may include a collapsible ladder (e.g. retractable steps, expandable length, etc.), a conventional ladder, or any other style of device deployable to anchor a vessel and/or permit a user to ingress and/or egress a vessel. One or more deployable marine systems may be used on a vessel.

The deployable marine system may be automatically and/or manually deployed into the water and/or bottom, and/or retracted from the water and/or bottom. The deployable marine system may anchor the vessel by deploying the anchor-ladder device into the water and causing an anchoring component of the anchor-ladder device to make contact with, become embedded within, engage, and/or otherwise become connected to the bottom of the body of water. The anchoring component may also, or alternatively, be associated with an rod (e.g., a pin, spike, auger, and/or some other attachment device) that can be automatically and/or manually extended to make contact with, become embedded within, engage, and/or otherwise become connected to the bottom of a body of water to anchor the vessel. The components illustrated in FIGS. 1A through 7 are provided for explanatory purposes only, and the disclosure herein is not intended to be limited to the components provided therein. There may be additional components, fewer components, different components, or differently arranged components than illustrated in FIGS. 1A through 7. Also, in some implementations, one or more of the components of the deployable marine system may perform one or more functions described as being performed by another one or more of the components of the deployable marine system. Further, the deployable marine system may be used outside of the marine environment, including, but not limited to, use in campers, trucks, outriggers, etc.

Figure 1A:
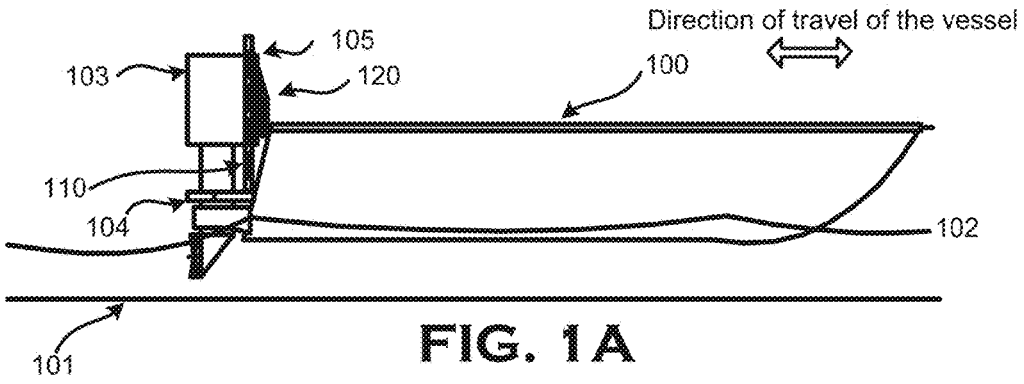
FIGS. 1A & 1B illustrate an example environment in which the apparatus, system, method and/or technology, described herein, may be implemented.
Figure 1B:
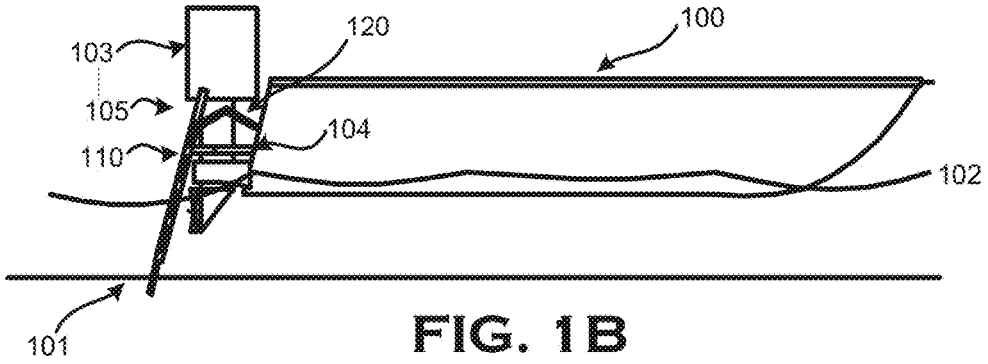

FIGS. 1A & 1B illustrate an example environment in which the apparatus, system, method and/or technology, described herein, may be implemented. For example, the environment may include a vessel 100 within a body of water 102 and a bottom surface 101 (bottom 101) under body of water 102. Vessel 100 may include a propulsion mechanism 103, a swim platform 104, and deployable marine system. Propulsion mechanism 103 is depicted as an outboard motor in FIGS. 1A & 1B for explanatory purposes, but need not be so limited. Additionally, or alternatively, propulsion mechanism 103 may include an inboard motor, an inboard-outboard motor, a sail (e.g., for wind powered vessel), and/or some other mechanism of propulsion for vessel 100. There may be additional components, fewer components, different components, or differently arranged components than illustrated in FIGS. 1A & 1B. Also, in some implementations, one or more of the components of the deployable marine system may perform one or more functions described as being performed by another one or more of the components of the deployable marine system. Further, the deployable marine system may be used outside of the marine environment, including, but not limited to, use in campers, trucks, outriggers, etc.

One or more marine deployable marine systems 105 may be mounted to vessel 100. While deployable marine system 105 is depicted in FIGS. 1A and 1B as being mounted to the stem of vessel 100, deployable marine system 105 may be mounted at other locations of vessel 100, including, for example, in proximity of the interior, bow, starboard side, port side or stem of vessel 100. Deployable marine system 105 may include an anchor-ladder device 110 and a deployment device 120.

Figure 4A:
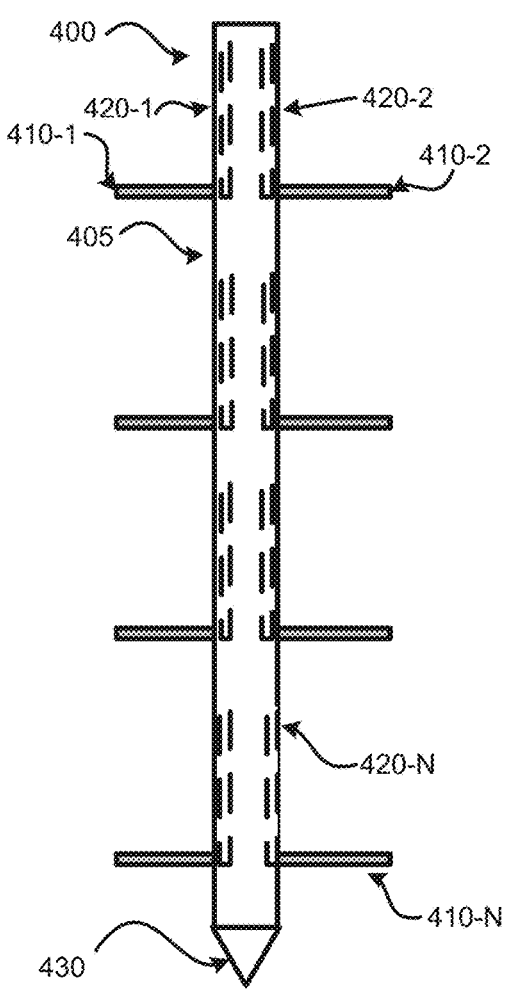
FIGS. 4A through 4B illustrate a non-limiting example embodiment of an anchor-ladder device used in a deployable marine system.
Figure 4B:
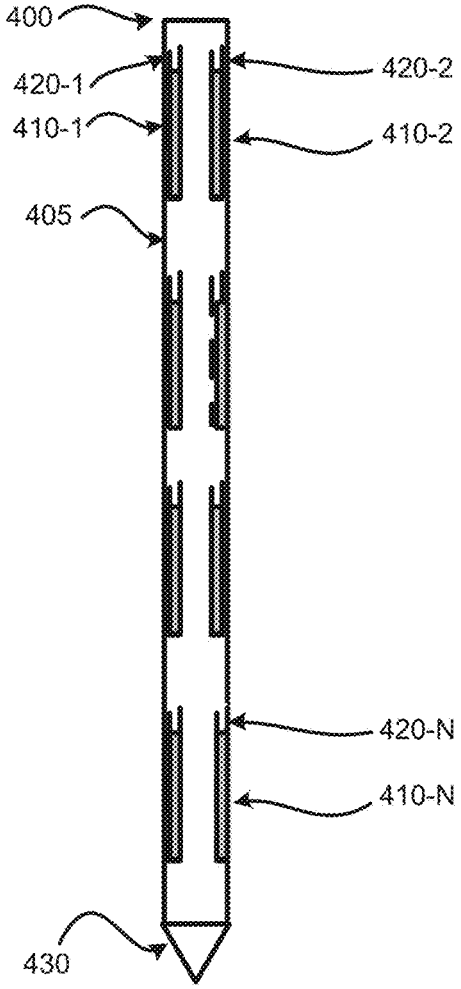

Anchor-ladder device 110, to be described in greater detail in FIGS. 4A through 4B and may include one or more components associated with an anchor device, a ladder device, and/or a combination of anchor and ladder devices. In a non-limiting example, anchor-ladder device 110 may enable vessel 100 to be anchored to the bottom surface 101 within body of water 102. Additionally, or alternatively, anchor-ladder device 110 may enable users to egress from vessel 100 to water 102 and/or ingress to vessel 100 from body of water 102.

Deployment device 120 may be attached to a vessel and may be connected (e.g. screw connection, brackets, pins, etc.) to one or more components of anchor ladder device 110. Deployment device 120 may be located partially inside of anchor-ladder device 110, such when deployment device is used to eoperate a component (e.g. a rod, a step, a ladder, etc.) associated with anchor ladder device 110. Deployment device 120 may include one or more components that enables anchor-ladder device 110 to be stored in a first position, as shown in FIG. 1A, which may maintain anchor-ladder device 110 above the surface of the body of water 102 (hereinafter, the "stowed position").

As shown in FIG. 1B, deployment device 120 may cause anchor-ladder device 110 to change from the first position (e.g., stowed position) to a second position in which anchor-ladder device 110 is extended into body of water 102 to allow users to ingress/egress the vessel 100 and/or to make contact with, become embedded within, engage, or otherwise be connected to bottom 101 to anchor vessel 100 or both. (hereinafter "deployed position"). Additionally, or alternatively, deployment device 120 may enable anchor-ladder device 110 to change from the second, deployed position to the first, stowed position by causing anchor-ladder device 110 to be disconnected and/or removed from bottom 101, and/or withdrawn from body of water 102. Additionally, or alternatively, deployment mechanism 120 may cause a shape, associated with anchor-ladder device 110, to be folded, extended, retracted and/or collapsed into a space and/or volume that is suitable for storage and/or transit on vessel 100. Additionally, or alternatively, deployment mechanism 120 may cause an anchor-ladder device 110 to be deployed at an angle suitable for ingressing and egressing the vessel 100. Deployment device 120 may include one or more of a hydraulic actuator, a pneumatic actuator, an electric actuator, a screw device, a hand crank, etc.

Figure 2A:
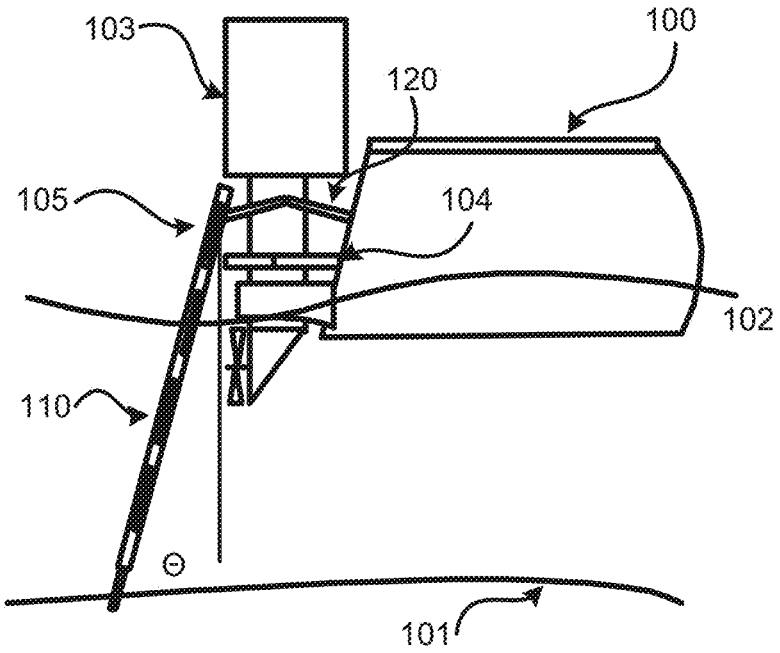
FIGS. 2A & 2B illustrate non-limiting example embodiments of an anchor-ladder device connected to the stern of a vessel.
Figure 2B:
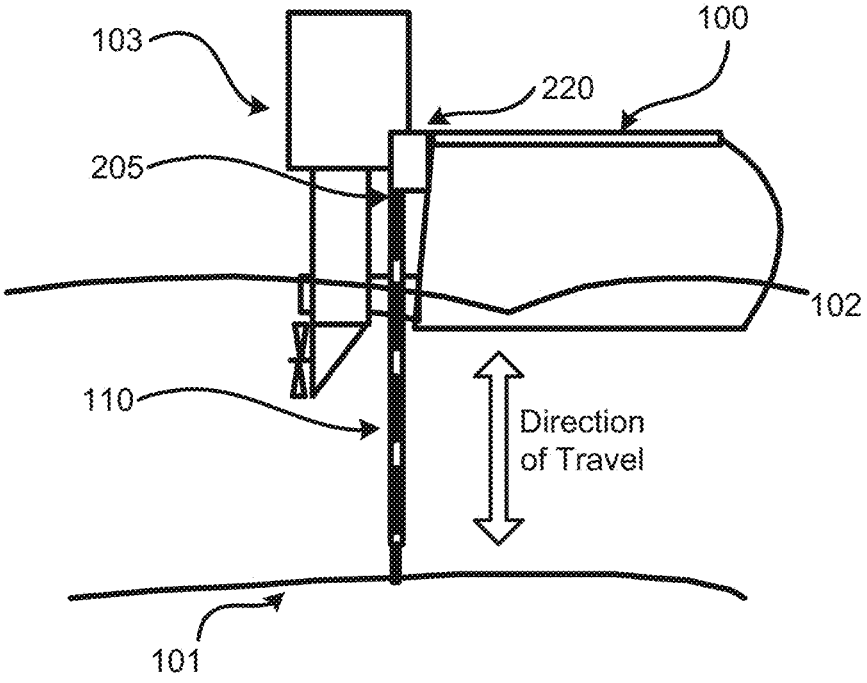

FIGS. 2A & 2B illustrate non-limiting example deployable marine systems mounted to vessel 100. As shown in FIG. 2A, a deployable marine system 105 may include a deployment device 120 that may control an incline angle (e.g., shown as "$\Theta$" in FIG. 2A) of the anchor-ladder device 110 when in the second, deployed position. The incline angle may be formed by an angle between a first, longitudinal axis of anchor-ladder device 110 and a second, substantially vertical axis that intersects the first axis. Controlling the inclined angle may enable vessel 100 to remain anchored to bottom 101 in changing conditions (e.g., rising or falling tides, current, rough water, etc.) and/or to enable users of the vessel 100 to more easily ingress and/or egress the vessel.

Alternatively, as shown in FIG. 2B, a deployable marine system 205 may include a vertical deployment device 220. Vertical deployment device 220 may deploy the anchor-ladder device 110 by extending anchor-ladder device 110 in one direction, towards bottom 101, and/or may stow the anchor-ladder device 110 by retracting it in the opposite direction. Deployment device 220 may connect to the anchor-ladder device 110 at the first end. Alternatively, the deployment device 220 may engage the anchor-ladder device 110 along its length and deploy/retract the anchor-ladder device by driving the anchor-ladder device 110 through the deployment device 220. In this example embodiment, the vertical deployment device 220 may include a track which engages the anchor-ladder device 110 along its length to deploy and/or retract the anchor-ladder device. The vertical deployment device 220 may deploy and/or retract the anchor-ladder device 110 by causing the anchor-ladder device to move vertically upward or downward along the track within the vertical deployment device 220.

Figure 3A:
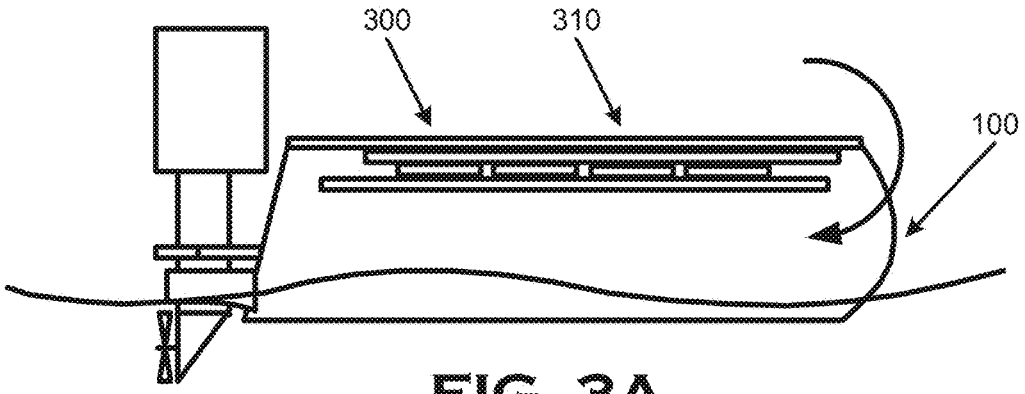
FIGS. 3A & 3B illustrate a non-limiting example embodiment of an anchor-ladder device mounted to the starboard side of a vessel.
Figure 3B:
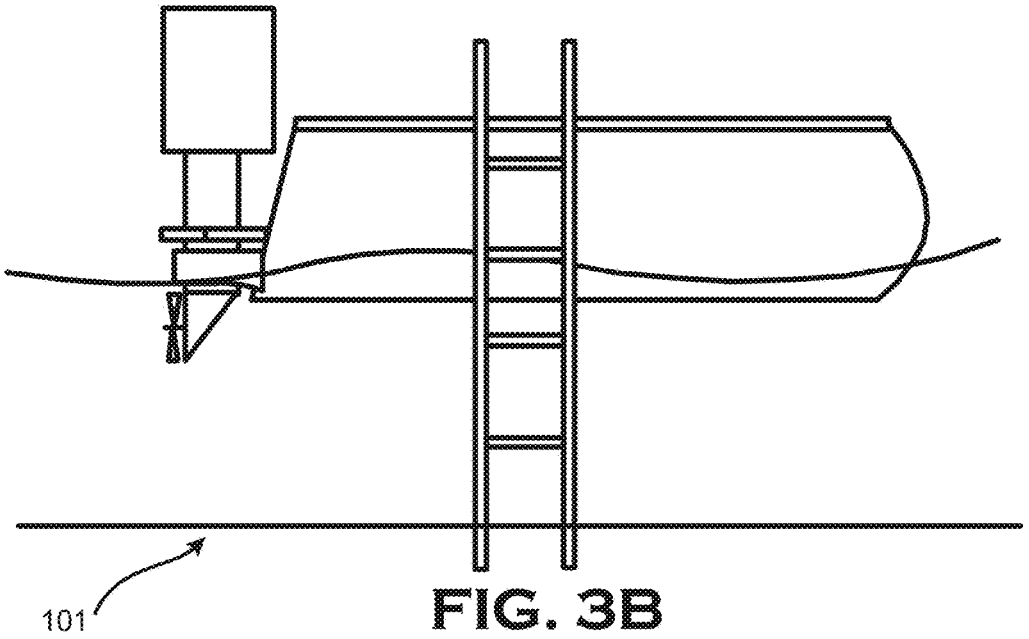

FIGS. 3A & 3B illustrate a non-limiting example deployable marine system 300 mounted to the starboard side of vessel 100. As shown in FIGS. 3A and 3B, deployable marine system 300 may include a rotatable deployment device 320 mounted on the starboard side of a vessel 100 and an anchor-ladder device 110. The rotatable deployment device 300 may deploy the anchor-ladder device 110 by rotating it approximately 90 degrees from its approximately horizontal, retracted state, depicted in FIG. 3A, to its deployed state, depicted in FIG. 3B. Further, the rotatable deployment device 320 may, in addition to rotating the anchor-ladder device 110, extend the anchor-ladder device 110 to deploy the anchor-ladder device further into a body of water 102 and/or to the bottom 101 of a body of water and/or retract the anchor-ladder device 110 from the body of water 102.

FIGS. 4A through 4B illustrate a non-limiting example of an anchor-ladder device 110. As shown in FIGS. 4A through 4B, anchor-ladder device 110 may include a collection of components, such as a member 405, a group of steps 410-1, . . . , 410-N (where N is greater than or equal to 1) (hereinafter individually a "step 410" or collectively, "stops 410"), a group of cavities 420-1, . . . , 420-N thereinafter individually "cavity 420" or collectively "cavities 420"), one or more pivot mechanisms (not shown) and a anchoring component 430. The components illustrated in FIGS. 4A through 4B are provided for explanatory purposes only, and the disclosure herein is not intended to be limited to the components reflected in the drawings. There may be additional components, fewer components, different components, or differently arranged components than illustrated in FIGS. 4A through 4B. Also, in some implementations, one or more of the components of anchor-ladder device 110 may perform one or more functions described as being performed by another one or more of the components of the anchor-ladder device 110.

Member 405 may be formed from a material (e.g., a metal alloy, composite, polymer, wood, ceramic, fiberglass, etc.) of sufficient strength and rigidity to support the weight of users using member 405, as well as any static and/or dynamic loads (e.g., forces, torques, tensions, compressions, stresses, strains, etc.) imparted on member 405 by the deployment device 120 (e.g., when deploying anchor-ladder device 110 into or retracting anchor-latter device 110 from bottom 101), vessel 100 via deployment device 120 (e.g, when floating on the surface of body of water 102 in changing conditions such as changing tides, currents, rough water, etc.), users when ingressing to and/or egressing from vessel 100, and/or any additional components of the deployable marine system 105. Member 405 may also, or alternatively, be formed from a material (e.g., stainless steel, polymer, composite, ceramic, fiberglass, etc.) of sufficient corrosion resistance and toughness to withstand exposure to water, air, saltwater, cleaning solvents, etc. as well as abrasive materials. (e.g. shells, sand, grit etc.). Member 405 may be composed of one or more pieces. The types and shapes of member 405 are not intended to be limited to those shown in FIGS. 4A through 4B. Member 405 may have a circular cross section, or may have another cross section (e.g. square, rectangle, 1-Beam, etc.), Member 405 may have a first end and a second end opposite the first end. A deployment device (e.g. deployment device 120, vertical deployment device 220, rotatable deployment device 320, etc.) may connected (e.g. fasteners, welding, a track system, bracketry, etc.) to member in proximity to the first end. The second end may be connected to anchoring component 430. Member 405 may be connected to steps 410.

Step 410 may form rungs of a ladder and be made from a material (e.g., a metal alloy, composite, polymer, wood, ceramic, fiberglass, etc.) of sufficient strength and rigidity to support of the weight of the users ingressing and egressing the vessel 100 as well as any other static and/or dynamic loads (e.g. forces, torques tensions, compressions, etc.) imparted to the steps 410. Steps 410 may also be formed from a material (e.g., stainless steel, polymer, composite, ceramic, fiberglass, etc.) of sufficient corrosion resistance and toughness to withstand exposure to water, air, saltwater, cleaning solvents, etc. as well as abrasive materials (e.g. shells, sand, grit etc.). Steps 410 may be composed of one or more pieces. Step 410 may have a sufficient thickness and/or strength to enable a user to grip step 410 with a hand and/or step on step 410 with a foot and/or to withstand the weight of the user while ascending or descending anchor-ladder device 110. Step 410 may be formed with a cross section or shape (e.g. flat, curved, rounded, etc) to allow users to comfortably and safely climb on and/or ingress or egress vessel 100. The cross section and/or shape may vary along the length of step 410. Steps 410 may also include an anti-slip surface (e.g. textured paint, silica pebbles, etc.) so that users may safely traverse the steps 410.

Step 410 may include a first end and second end that is opposite the first end. The first end may be pivotably connected to member 405 by a pivot mechanism (e.g., hinge, bearing, pin, screw, etc.) (not shown). Pivot mechanism may enable step 410 to pivot from a first, open position, depicted in FIG. 4A, to a second, closed position, depicted in FIG. 4B, that allows some or all of step 410 to fit within cavity 420. Cavity 420 may be formed by a void or cavity within member 405. Cavity 420 may include a recess located on an exterior surface of member 405 within which some or all of step 410 may be located when step is in the closed position, as shown in FIG. 4B. Step 410 may be manually extended from/retracted into cavity 420 (e.g. by hand, by a lever, etc) or may be automatically extended/retracted from cavity 420 (e.g. by hydraulics, pneumatics, an electric solenoid, etc.), including by deployment device 120. Alternatively, steps 410 may be rigidly affixed to member 405, in which case steps 410 may not pivot from a closed position to an open position but, rather, would remain in an open position.

As shown in FIG. 4B, cavity 420 may have a cross section that is configured to maintain step 410 partially or substantially flush with the surface of the member 405 when step 410 is retracted therein. Alternatively, cavity 420 may be configured to maintain step 410 proud or sub flush the surface of the member 405.

Anchoring component 430 may be configured to connect vessel 100 to bottom 101 to anchor vessel in the body of water. Anchoring component 430 may be formed from a material (e.g. a metal alloy, composite, polymer, wood, ceramic, fiberglass, etc.) of sufficient strength and rigidity to enable anchoring component 430 to anchor vessel 100 to bottom 101*d* of a body of water 102, and/or to support the weight of anchor-ladder device 110, the force imparted on the anchoring component 430 when it is in contact with the bottom 101 as well as any static and/or dynamic loads (e.g., forces, torques, tensions, compressions, stresses, strains, etc.) imparted on the anchoring component 430 by the deployment device 120, the vessel 100, etc. Anchoring component 430 may also be formed from a material (e.g. stainless steel, polymer, composite, fiberglass, etc.) of sufficient corrosion resistance and toughness to withstand operation in water, air, saltwater and the like as well as abrasive environments (e.g. shells, sand, grit etc.). Anchoring component 430 may, for example, be made of plastic, metal, acrylic, fiberglass, wood composite or a combination thereof. Anchoring component 430 may have a first end and a second end opposite the first end. Anchoring component 430 may be composed of one or more pieces. The second end of anchoring component 430 may be configured to be detachably mounted (e.g. screw-mounted, glued, press fit, pinned connection, etc.) to the member 405. The first end of anchoring component 430 may connect to the bottom 101 to anchor the vessel in the body of water.

The second end of the anchoring component 430 may be a pointed shape, such as the spike depicted in FIGS. 4A and 4B, or it may be another shape (e.g. domed, flat, textured) depending upon the type of bottom 101 to which it is exposed (e.g. sand, rack, shell, mud, etc.). When the second end is formed in the shape of a spike, a user may connect the anchoring component 430 to the bottom by applying a downward force to the anchoring component 430 to drive the spike into the bottom. In another embodiment, the second end may be a bit, which, similar to the function of a drill bit, may be rotated to penetrate the bottom 101 of the body of water. In another embodiment, the second end of the anchoring component 430 may take on the shape of a conventional anchor (e.g. a Danforth anchor, a plow, a spade, a claw-style, etc.). Those of ordinary skill in the art know that the optimal shape of the anchoring component 430 varies depending upon the conditions present and on the bottom of the body of water. The types and shapes of anchoring component 430 shown in FIGS. 4A and 4B are not intended to be limiting.

Figure 5A:
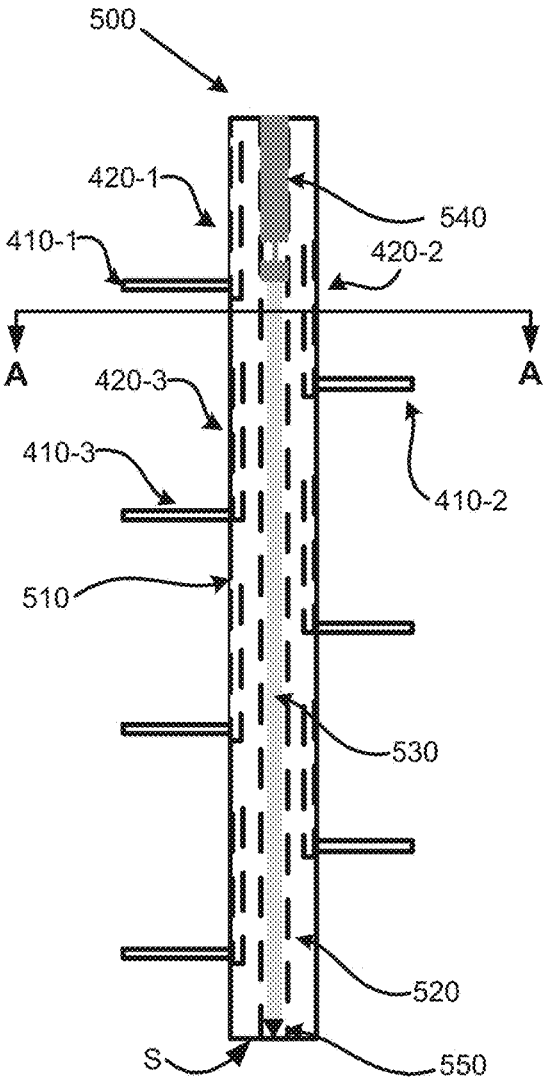
FIG. 5A through 5C illustrate a non-limiting example embodiment of an anchor-ladder device used in a deployable marine system.
Figure 5B:
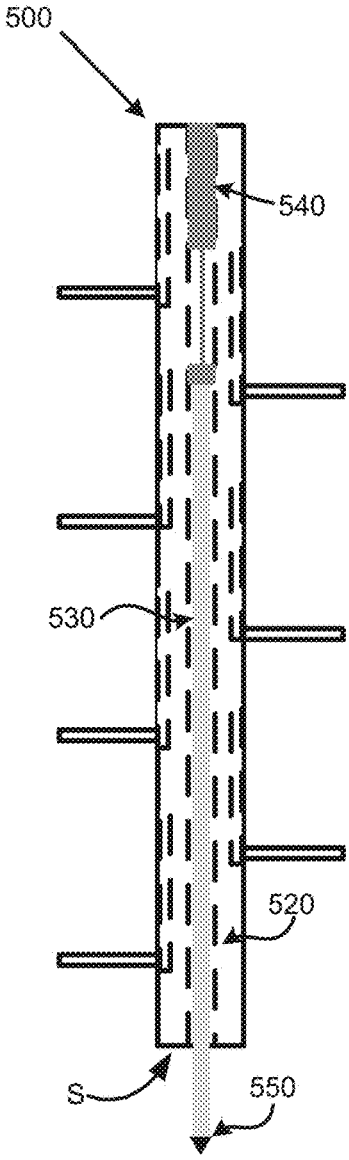
Figure 5C:
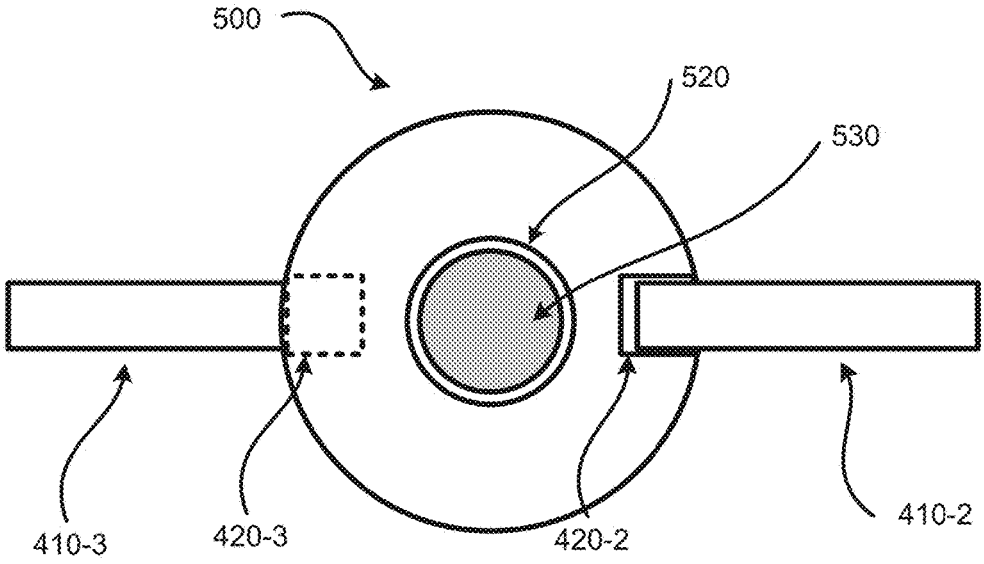

FIG. 5A through 5C illustrate a non-limiting example embodiment of an anchor-ladder device used in a deployable marine system. As depicted in FIG. 5A, an example embodiment of an anchor-ladder device may be an extendable anchor-ladder device 500 (hereinafter "extendable anchor-ladder 500"). Anchor-ladder device 500 may include a member 510, a hollow channel 520, rod 530, a rod mechanism 540, an anchoring component 550, one or more pivot mechanisms depicted in FIG. 5C only) and may define a lower surface S. The extendable anchor-ladder 500 may be connect (e.g. mechanical fasteners, welding, track system etc.) to a deployment device, such as deployment device 120, and may be deployable to anchor a vessel 100 to a bottom 101 or for ingress air egress, and may be stowable above the surface of a body of water 102. The extendable anchor-ladder 500 may be used in any anchor-ladder mechanism the anchor-ladder 110 may be used, including in conjunction with the deployment device 120, depicted 1A, 1B, 2A; the vertical deployment device 220, depicted in FIG. 2B; and the rotatable anchor-ladder deployment device 320, depicted in FIGS. 3A and 3B. The components illustrated in FIGS. 5A through 5C are provided for explanatory purposes only, and the disclosure herein is not intended to be limited to the components reflected in the drawings. There may be additional components, fewer components, different components, or differently arranged components than illustrated in FIGS. 5A through 5C. Also, in some implementations, one or more of the components of anchor-ladder device 500 may perform or more functions described as being performed by another one or more of the components of the anchor-ladder device 500.

Member 510 may be formed from a material or materials (e.g. a metal alloy, composite, polymer, wood, ceramic, fiberglass, etc.) of sufficient strength to support the weight of the extendable anchor-ladder 500, the forces imparted on the extendable anchor-ladder 500 when users ingress and egress a vessel 100, the force imparted on the extendable anchor-ladder 500 when it is in contact with the bottom 101 as well as any static and/or dynamic loads (e.g., forces, torques, tensions, compressions, etc.) imparted on member 510 by the deployment device 120, the vessel 100, the rod 530, the rod mechanism 540 and/or any other components of anchor ladder device 500. Member 510 may also be formed from a material (e.g. stainless steel, polymer, composite, fiberglass, etc.) of sufficient corrosion resistance and toughness to withstand operation in water, air, saltwater and in abrasive environments (e.g. sand, shells, grit, etc.). Member 510 may be composed of one or pieces. The types and shapes of member 510 are not intended to be limited to those shown in FIGS. 5A through 5C. Member 510 may have a circular cross section, as depicted in FIG. 5C, or may another cross section (e.g. square, rectangular, I-beam, etc.).

Member 510 may have a first end and a second end opposite the first end. A deployment device (e.g. deployment device 120, vertical deployment device 220, rotatable deployment device 320, etc.) may connected (e.g. fasteners, welding, a track system, bracketry, etc.) to member 510 in proximity to the first end. The second end may be associated with anchoring component 530 as discussed further below. Member 405 may be connected to steps 410. As depicted in FIG. 5C, Member 510 may include a hollow channel 520 which may be a void in the member 510 within which rod 530 may be located when in a retracted position as discussed further. Member 510 may have a relatively thin material thickness (e.g. I-beam cross section, C-channel, etc.). Hollow channel 520 may reside on an outer surface of member 510, anywhere within member 510 and/or partially within member 510. As depicted in FIG. 5A, hollow channel may reside along a longitudinal axis of member 510. The hollow channel 520 may have a cross section (e.g. circular, square, etc.) which may vary along the length of the hollow channel and which may be complimentary to the rod 530. The hollow channel 520 may extend from a lower surface S of the member 510 through the entire length of the member 510 or some portion thereof. The hollow channel 520 may also house some or all of the rod mechanism 540 and may have a cross section complimentary thereto.

Anchor-ladder device 500 may also include a rod 530. The rod may be formed from a material or materials (e.g. metal alloy, composite, polymer, wood, ceramic, fiberglass, etc.) of sufficient strength to support the weight of the extendable anchor-ladder 500, the forces imparted on the rod 530 when users ingress and egress the vessel 100, the force imparted on the rod by the bottom 101 as well as any static and/or dynamic loads (e.g., forces, torques, tensions, compressions, etc.) imparted on the rod 530 by the deployment device 120, the vessel 100, the anchoring component 550, and/or any other additional components of anchor-ladder device 500. Rod 530 may also be formed from a material or materials (e.g. stainless steel, polymer, composite, ceramic, fiberglass, etc.) of sufficient corrosion resistance and toughness to withstand operation in water, air, saltwater and abrasive environments (e.g. sand, shells, grit, etc.). Rod 530 may be composed of one or pieces and may have a circular cross section, as depicted in FIG. 5C, or another cross section (e.g. square, triangular, rectangular, I-beam, C-channel, etc.) which does not prevent rod 530 from moving relative to hollow channel 530.

Rod 530 may be associated with member 510 and may extend longitudinally through hollow channel 520. Rod 530 may have a third end and a fourth end opposite the third end.

The third end of the rod 530 may be connectable (e.g. threaded, press fit, adhesive, fasteners, etc.) to a rod mechanism 540. Additionally, or alternatively, third end of rod 530 may be connected to deployment device, such as deployment device 120. In this configuration, deployment device may extend rod 530 through hollow channel 520 to extend anchoring component 550 below lower surface to enable anchor-ladder device 500 to anchor a vessel in deeper water than when rod 530 is not extended. Additionally, or alternatively, deployment device may retract rod 530 from an extended position to a retracted position. The fourth end of the rod may be connectable (e.g. threaded, press fit, adhesive, fasteners, etc.) to anchoring component 550. Rod 530 may be deployed by the rod mechanism 540 to connect to the bottom 101 to anchor the vessel. The rod may be retracted by the rod mechanism 540 to store rod 530 within hollow channel 520 when a user does not need to extend rod 530 to anchor the vessel.

Anchor-ladder device 500 may also include a rod mechanism 540 (e.g. a hydraulic actuator, pneumatic actuator, electric actuator, screw drive, etc.), which may receive power from the deployment device 120, may receive power from another source, or may be operated manually (e.g. hand crank, screw drive). The rod mechanism 540 may be operable to extend the rod 530 below a lower surface S of the member 510, as shown in FIG. 5B, in order to anchor the vessel 100. The rod mechanism 540 may also retract the rod 240 such that it resides predominantly within the member 510 above surface S, as shown in FIG. 5A.

Anchor-ladder device 500 may also include anchoring component 550, which may be integral with, affixed to (e.g. welded, etc.) or detachably connected to (e.g. screw-mounted, press fit, etc.) the rod 530. Anchoring component 550 may facilitate anchoring the vessel 100 to the bottom 101. The anchoring component 550 may be formed from a material or materials (e.g. a metal alloy, composite, polymer, wood, ceramic, fiberglass, etc.) of sufficient strength to support the weight of the extendable anchor-ladder 500, the force imparted on the anchoring component 550 when it is in contact with the bottom 101 as well as any static and/or dynamic loads (e.g., forces, torques, tensions, compressions, etc.) imparted on the anchoring component 550 by the deployment device 120, the vessel 100 and/or any other additional components. Anchoring component 550 may also be formed from a material or materials (e.g. stainless steel, polymer, composite, ceramic, fiberglass, etc.) of sufficient corrosion resistance and toughness to withstand operation in water, air, saltwater and abrasive environments (e.g. sand, shells, grit, etc.). Anchoring component 550 may be composed of one or more pieces. The types and shapes of anchoring component 550 are not intended to be limited to those depicted in FIGS. 5A and 5B.

Anchoring component 550 may have a first end and a second end opposite the first end. The anchoring component 550 may engage rod 530 at the first end and may be configured engage the bottom 101 proximate the second end. The second end of the anchoring component 550 may be pointed like spike as depicted in FIGS. 5A and 5B, or it may be another shape (e.g. domed, flat, textured) depending upon the environment to which it is exposed (e.g. sand, rack, shell, mud, etc.). When the second end is formed in the shape of a spike, a user may connect the anchoring component 550 to the bottom by applying a downward force to the anchoring component 550 to drive the spike into the bottom. In another embodiment, the second end may be a bit, which, similar to the function of a drill bit, may be rotated to penetrate the bottom 101 of the body of water. In another embodiment, the second end of the anchoring component 430 may take on the shape of a conventional anchor (e.g. a Danforth anchor, a plow, a spade, a claw-style, etc.). Those of ordinary skill in the art know that the optimal shape of the anchoring component 550 varies depending upon the conditions present and on the bottom of the body of water. The types and shapes of anchoring component 550 shown in FIGS. 5A and 5B are not intended to be limiting.

Figure 6A:
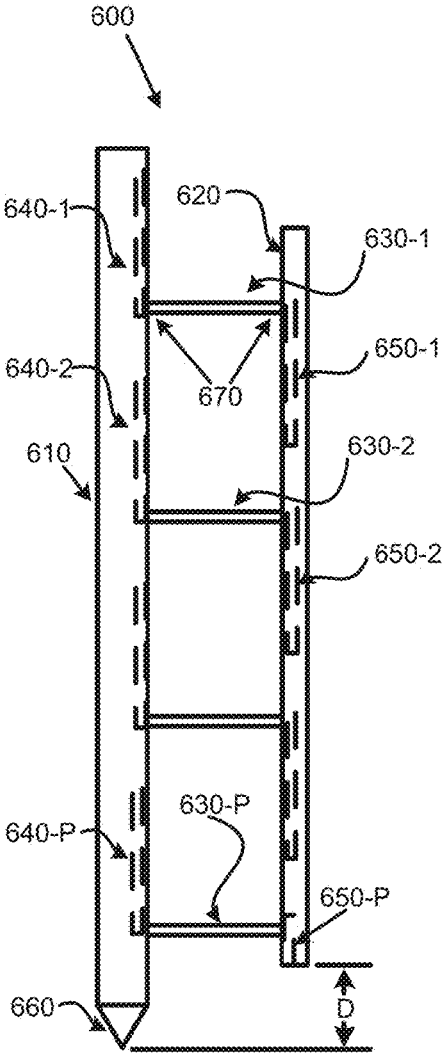
FIGS. 6A through 6C illustrate a non-limiting example embodiment of an anchor-ladder device used in a deployable marine system.
Figure 6B:
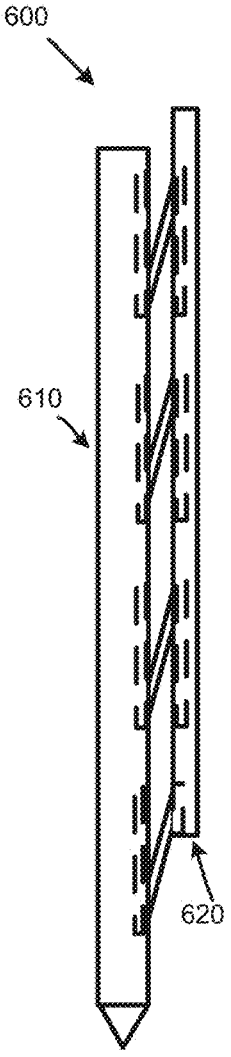
Figure 6C:
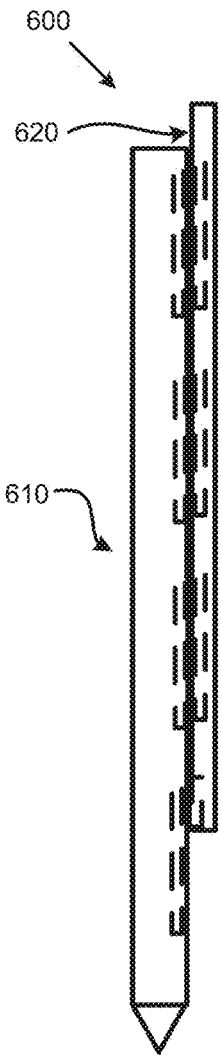

FIGS. 6A through 6C illustrate a non-limiting example embodiment of an anchor-ladder device used in a deployable marine system. As shown in FIG. 6A, anchor-ladder device 600 may contain first member 610, second member 620, a group of steps 630-1 . . . 630-P (where P is greater than or equal to 1) (hereinafter "step 630" or "steps 630"), a group of cavities 640-1, . . . , 640-P (hereinafter "cavity 640" or "cavities 640"), a group of second member cavities 650-1, . . . , 650-P (hereinafter "second member cavity 650" or "second member cavities 650"), anchoring component 660, one or more pivot mechanisms 670 (not shown) and defining a distance D. The components illustrated in FIGS. 6A through 6C are provided for explanatory purposes only, and the disclosure herein is not intended to be limited to the components reflected in the drawings. There may be additional components, fewer components, different components, or differently arranged components than illustrated in FIGS. 6A through 6C. Also, in some implementations, one or more of the components of anchor-ladder device 600 may perform one or more functions described as being performed by another one or more of the components of the anchor-ladder device 600. Additionally, anchor-ladder device 600 may include one or more of the features of one or more of the other example embodiment depicted herein. For example, anchor-ladder device 600 may include a hollow chamber, within first member 610, and a rod, connected to anchoring component 660, that extends longitudinally from the hollow chamber similar to the function of anchor-ladder device 500.

Anchor-ladder device 600 may be connectable (e.g. mechanical fasteners, welding, track system etc.) to a deployment device 120, may be deployable to anchor a vessel 100 to a bottom 101 or for ingress or egress, and may be stowable/retractable above a the surface of a body of water 102. The foldable anchor-ladder 600 may be used in any anchor-ladder mechanism the anchor-ladder device 110 may be used, including in conjunction with the deployment device 120, depicted in FIGS. 1A, 1B and 2A; the vertical deployment device 220, depicted in FIG. 2B; and the rotatable anchor-ladder deployment device 320, depicted in FIGS. 3A and 3B.

The first member 610 may be formed from a material or materials (e.g. a metal alloy, composite, polymer, wood, ceramic, fiberglass, etc.) of sufficient strength to support the weight of the foldable anchor-ladder 600, the forces imparted on the first member 610 when users ingress and egress the vessel 100, the force imparted on the first member 610 by the bottom 101 as well as any static and/or dynamic loads (e.g., forces, torques, tensions, compressions, etc.) imparted on the first member 610 by the steps 630, the deployment device 120, the vessel 100 and/or any other additional components. First member 610 may also be formed from a material of sufficient corrosion resistance and toughness to withstand operation in water, air, saltwater and abrasive environments (e.g. sand, shells, grit, etc.). First member 610 may be composed of one or pieces. The types and shapes of first member 610 are not intended to be limited to those depicted in FIGS. 6A through 6C.

First member 610 may have a first end and a second end opposite the First end. First ember may be connected to a deployment device 120 at or near the first end and may be connected to a anchoring component 660 at the second end. Anchoring component may connect to bottom 101 to anchor a vessel 100 and otherwise be identical to anchoring component 430. First member may pivotally connect by pivot mechanisms 670 (not shown) to steps 630 and may contain cavities 640, which may be configured to maintain steps 630, or portions thereof, within first member 610. Pivot mechanisms 670 may be operate the same as, and otherwise be equivalent to, pivot mechanisms.

Second member 620 may be formed from a material or materials (e.g. a metal alloy, composite, polymer, wood, ceramic, fiberglass, etc.) of sufficient strength to support the weight of the foldable anchor-ladder 600, the forces imparted on the second member 620 when users ingress and egress the vessel 100, the force imparted on the second member 620 by the bottom 101 as well as any static and/or dynamic loads (e.g., forces, torques, tensions, compressions, etc.) imparted on the second member 620 by the deployment device 120, the vessel 100 and/or any other additional components. Second member 620 may also be formed from a material or materials (e.g. stainless steel, polymer, composite, ceramic, fiberglass, etc.) of sufficient corrosion resistance and toughness to withstand operation in water, air, saltwater and abrasive environments (e.g. shells, sand, grit etc.). Second member 620 may be composed of one or more pieces.

Second member 620 and first member 610 may form the sides of a ladder. Second member 620 may be generally parallel to first member 610. Second member 620 may pivotally connect to steps 630 using pivot mechanisms 670. Users of a vessel may use grasp second member 620 when ingressing or egressing the vessel 100. Second member 620 may contain second member cavities 650, which may be configured to maintain steps 630, or portions thereof, within second member 620, such as when the foldable anchor-ladder 600 is closed, as shown in FIG. 6C.

Steps 630 may be used by a user to ingress and egress the vessel and may be formed from a material or materials (e.g. a metal alloy, composite, polymer, wood, ceramic, fiberglass, etc.) of sufficient strength to support the forces imparted on the steps 630 when users ingress and egress the vessel 100 as well as any static and/or dynamic loads (e.g., forces, torques, tensions, compressions, etc.) imparted on the steps 630 by the deployment device 120, the vessel 100 and/or any other additional components. Steps 630 may also be formed from a material or materials (e.g. stainless steel, polymer, composite, ceramic, fiberglass, etc.) of sufficient corrosion resistance and toughness withstand operation in water, air, saltwater and abrasive environments (e.g. sand, shell, grit, etc.). Steps 630 may be composed of one or more pieces. Steps 630 may also include an anti-slip surface (e.g. textured paint, silica pebbles, etc.) so that users may safely traverse the steps 630.

Steps 630 may connect the first member 610 to the second member 620. Steps 630 may be pivotally connected to the first member 610 and the second member 620, such as by using pivot mechanisms 670, to allow the foldable ladder-anchor 600 to be rotated into a closed position, as depicted in FIG. 6C, for storage. When the foldable ladder-anchor 600 is rotated into a closed position, the steps 630 may reside primarily within the cavities 640 and the second member cavities 650. The anchor-ladder device 600 may be manually (e.g. by hand, lever, etc.) or automatically (e.g. hydraulics, pneumatics, electric solenoids, etc.) opened and closed. Additionally, or alternatively, anchor-ladder device 600 may be operated from the open position to the closed position and/or from the closed position to the open position by the deployment device. For example, the deployment device may provide power (e.g. hydraulic power, pneumatic power, electrical power, mechanical power, etc.) to open and/or close anchor-ladder device 600. Additionally, or alternatively, deployment device may operate a lock (e.g. a pin, an uplock device, etc.) that may prevent anchor ladder device 600 from operating from an open position to a closed position and/or from a closed position to an open position. When the anchor-ladder device 600 is opened, as depicted FIG. 6A, the second member may reside some distance D above anchoring component 660. This distance D may be established to be sufficient to preclude the second member 620 from contacting the bottom 101 when the foldable anchor-ladder 600 is opened, deployed and embedded within the bottom 101 in normal conditions.

Figure 7:
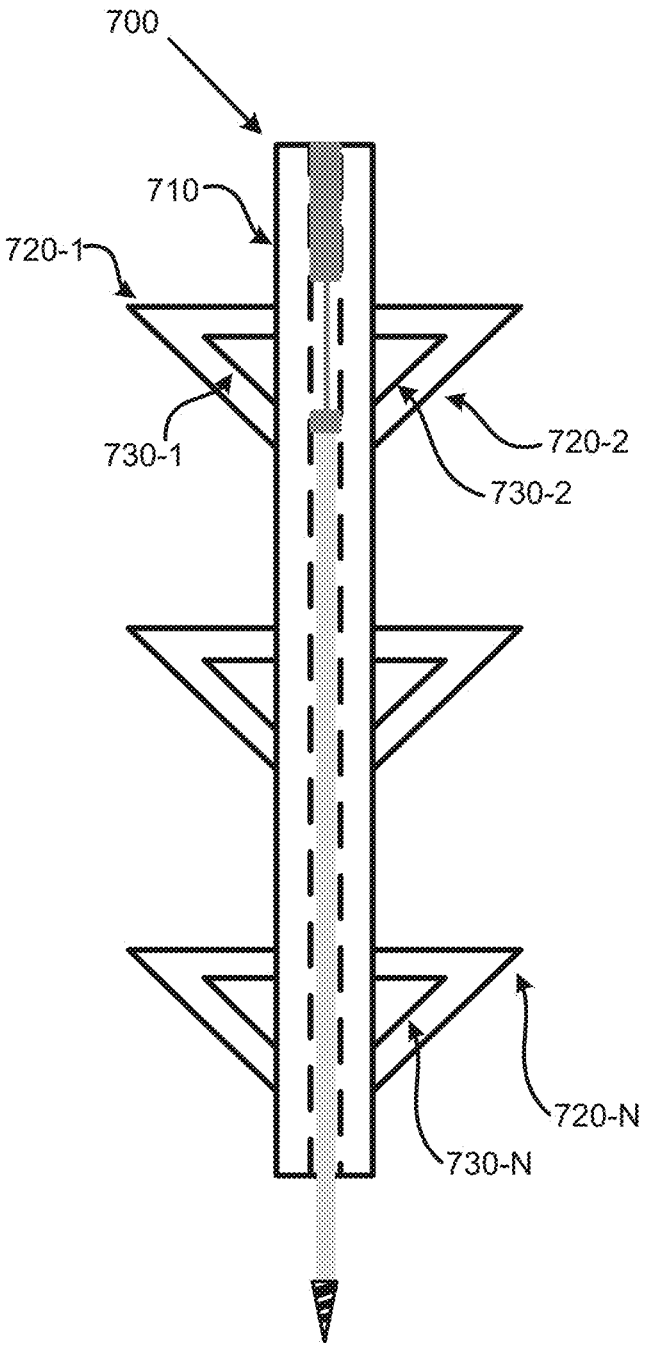
FIG. 7 illustrates a non-limiting example embodiment of an anchor-ladder device used in a deployable marine system.

FIG. 7 illustrates a non-limiting example embodiment of an anchor-ladder device used in a deployable marine system. As shown in FIG. 7, anchor-ladder device 700 may contain a member 710, and a group of steps 720-1 . . . 720-N (where N is greater than or equal to 1) (hereinafter "step 720" or "steps 720"). The components illustrated in FIG. 7 are provided for explanatory purposes only, and the disclosure herein is not intended to be limited to the components reflected in the drawings. There may be additional components, fewer components, different components, or differently arranged components than illustrated in FIG. 7. Also, in some implementations, one or more of the components of anchor-ladder device 700 may perform one or more functions described as being performed by another one or more of the components of the anchor-ladder device 700. Additionally, anchor-ladder device 700 may include one or more of the features of one or more of the other example embodiment depicted herein. For example, anchor-ladder device 700 is depicted with a hollow chamber and a rod, similar to that depicted for anchor-ladder device 500. In other configurations, anchor-ladder device may not have a hollow chamber or a rod.

Anchor-ladder device 700 may function similar to anchor-ladder device 500 except that anchor-ladder device 700 may include steps 720 that are rigidly connected to member 710 (e.g. formed as a part of member 710, welded to member 710, bolted to member 710, riveted to member 710, etc.). Steps 720 may provide a surface on which a user may step when ingressing and/or egressing a vessel. The steps 720 of anchor-ladder device 700 are not deployed but, rather, remain in a position that allows them to be used by a user to ingress a vessel and/or to egress a vessel without operating steps 720 to change the position and/or orientation of steps 720. While steps 720 are depicted to be generally triangularly shaped, steps 720 may be any shape (e.g, circular, square, oval, etc.). Further, steps 720 may include a group of handles 730-1 . . . 730-N (where N is greater than or equal to 1) (hereinafter "handle 730" or "handles 730") which may correspond to an absence of material that provides a holding surface to a user when a user is ingressing a vessel and/or egressing a vessel. Additionally, or alternatively, steps 720 may be solid and/or may not contain handles 730. Steps 720 may protrude from the surface of member 710. Additionally, or alternatively, steps 720 may be contours on the surface of member 710.

While preferred embodiments have been shown and described, those skilled in the art will recognize that other changes and modifications may be made to the foregoing embodiments without departing from the scope and spirit of the disclosure provided herein. For example, specific shapes of various elements of the illustrated embodiments may be altered to suit particular applications. It is intended to claim all such changes and modifications as fall within the scope of the disclosure herein and the equivalents.

The foregoing description provides illustration and description, but is not intended to be exhaustive or to limit the implementations to the precise form disclosed. Modifications and variations are possible in light of the above disclosure or may be acquired from practice of the embodiments.

It will be apparent that the apparatus, devices, systems, methods, technologies and/or techniques, as described above, may be implemented in many different forms of hardware and/or materials in the implementations described herein and illustrated in the figures. The actual or specialized hardware and/or materials used to implement these the apparatus, devices, systems, methods, technologies and/or techniques is not limiting of the embodiments—it being understood that hardware and/or materials can be designed to implement the apparatus, devices, systems, methods, technologies and/or techniques based on the description herein.

It should be emphasized that the terms "comprises"/"comprising" when used in this specification are taken to specify the presence of stated features, integers, steps or components but does not preclude the presence or addition of one or more other features, integers, steps, components or groups thereof.

Even though particular combinations of features are recited in the claims and/or disclosed in the specification, these combinations are not intended to limit the disclosure of the embodiments. In fact, many of these features may be combined in ways not specifically recited in the claims and/or disclosed in the specification. Although each dependent claim listed below may directly depend on only one other claim, the disclosure of the embodiments includes each dependent claim in combination with every other claim in the claim set.

No element, act, or instruction used in the present application should be construed as critical or essential to the embodiments unless explicitly described as such. Also, as used herein, the article "a" and "an" are intended to include one or more items and may be used interchangeably with "one" or "more." Where only one item is intended, the term "one" or similar language is used. Further, the phrase "based on" is intended to mean "based, at least in part, on" unless explicitly stated otherwise.

What is claimed is:

1. A deployable marine system for anchoring a vessel in a body of water and to enable a user to ingress into the vessel from the body of water or egress out of the vessel and into the body of water, the deployable marine system comprising:

an anchor-ladder device that includes a first member and one or more steps, the first member including a first end and a second end opposite the first end, the second end being associated with an anchoring component that is connectable to a bottom of the body of water to anchor the vessel, the one or more steps being attached to the first member and able to support the loads imparted by the user when ingressing into or egressing out of the vessel;

a deployment device, attached to the vessel, that is connected to the first member in proximity to the first end, the deployment device be able to deploy the anchor-ladder device into the body of water or to retract the anchor-ladder device from the body of water.

2. The deployable marine system of claim 1, where the anchoring component corresponds to at least one of:

a spike,
a bit,
an anchor,
a dome,
a textured surface, or
a flat surface.

3. The deployable marine system of claim 1, where the first member further includes a hollow channel and a rod that extends longitudinally through the hollow channel, the rod further including:

a third end connected to the deployment device; and
a fourth end connected to the anchoring component.

4. The deployable marine system of claim 3, where the anchoring component corresponds to a spike, the rod sliding longitudinally within the hollow channel to at least one of:

to extend the spike into the bottom of the body of water; or
to retract the spike into the bottom of the body of water.

5. The deployable marine system of claim 3, where the anchoring component corresponds to a bit, the rod rotating within the hollow channel to at least one of:

to screw the bit into the bottom of the body of water; or
to unscrew the bit from the bottom of the body of water.

6. The deployable marine system of claim 1, further comprising a second member generally parallel with the first member, the second member being attached to the one or more steps.

7. The deployable marine system of claim 1, where a first step, of the one or more steps, includes a third end and a fourth end opposite the third end, the third end being pivotally attached to the first member; and
the fourth end being pivotally attached to a second member generally parallel to the first member.

8. The anchor-ladder device of claim 1, where the first member further includes cavities associated with the one or more steps, some portion of each step, of the one or more steps, located within a portion of a cavity, of the cavities, when the steps are in a closed position.

9. The anchor-ladder device of claim 1, where the one or more steps are rigidly connected to the first member.

10. The anchor-ladder device of claim 1, where the one or more steps are pivotally connected to the first member.

11. The anchor-ladder device of claim 3, where the hollow channel is located:

along a longitudinal axis of the first member;
inside of the first member;
on an exterior surface of the first member; or
partially inside of the first member.

12. The anchor-ladder device of claim 3, where the rod has a cross section that corresponds to a circle,
a square,
a rectangle,
an oval,
a triangle,
an I-Beam, or
a C-channel.

13. The deployable marine system of claim 1, where the deployment device includes at least one of:

a hydraulic actuator,
a pneumatic actuator,
an electric actuator,
a screw drive, or
a hand crank.

14. An anchor-ladder device for anchoring a vessel in a body of water and to enable a user to ingress into the vessel from the body of water or egress out of the vessel and into the body of water, the anchor-ladder device comprising:

a member and one or more steps attached to the member and able to support the loads imparted by the user when ingressing into or egress ng out of the vessel, the member including:

a first end and a second end opposite the first end, the second end being associated with an anchoring component that is connectable to a bottom of the body of water to anchor the vessel, the first end being connectable to a deployment device or a rod mechanism;

a hollow channel and a rod that extends longitudinally through the hollow channel, the rod further including:

a third end connectable to a deployment device or a rod mechanism; and a fourth end connected to the anchoring component.

15. The anchor-ladder device of claim 14, where the one or more steps are pivotally connected to the member to allow the steps to pivot from a closed position to an open position.

16. The anchor-ladder device of claim 14, where the member further includes cavities associated with the one or more steps, some portion of each step, of the one or more steps, located within a portion of a cavity, of the cavities, when the steps are in a closed position.

17. The anchor-ladder device of claim 14, where the anchoring component corresponds to at least one of:

a spike, a bit, an anchor, a dome, a textured surface, or a flat surface.

18. The anchor-ladder device of claim 14, where the hr flow channel is located:

along a longitudinal axis of the first member;

inside of the first member;

on an exterior surface of the first member; or partially inside of the first member.

19. An anchor-ladder device for anchoring a vessel in a body of water and to enable a user to ingress into the vessel from the body of water or egress out of the vessel and into the body of water, the anchor-ladder device comprising:

a first member that includes a first end and a second end opposite the first end, the second end being associated with an anchoring component that is, connectable to a bottom of the body of water to anchor the vessel, the first end being connectable to a deployment device;

a second member generally parallel with the first member;

one or more steps pivotally connected to the first member and the second member, the one or more steps being able to support the loads imparted by the user when ingressing into or egressing out of the vessel.

20. The anchor-ladder device of claim 19, where the first member further includes a hollow channel and a rod extending longitudinally through the hollow channel, the rod including a third end and a fourth end opposite the third end;

the third end being connectable to a deployment device or a rod mechanism; and the fourth end being connected to the anchoring component.

21. The anchor-ladder device of claim 19, where at least one of the first member or the second member further includes cavities associated with the steps, some portion of each step, of the one or more steps, located within a portion of a cavity, of the cavities, when the steps are in a closed position.

* * * * *